US006809644B1

(12) United States Patent
Titus et al.

(10) Patent No.: US 6,809,644 B1
(45) Date of Patent: Oct. 26, 2004

(54) PACIFIER LOCATOR SYSTEM

(76) Inventors: Crystal D. Titus, P.O. Box 124, Walton, IN (US) 46994-0124; Tracy L. Pugh, P.O. Box 124, Walton, IN (US) 46994-0124

( * ) Notice: Subject to any disclaimer, the term of this patent is extended or adjusted under 35 U.S.C. 154(b) by 0 days.

(21) Appl. No.: 10/294,503

(22) Filed: Nov. 15, 2002

(51) Int. Cl.[7] ..... G08B 1/08

(52) U.S. Cl. ..... 340/539.32; 340/539.15; D24/194

(58) Field of Search ..... 340/539, 539.1, 340/539.32; 606/234, 235, 236; D24/194, 195, 196

(56) References Cited

U.S. PATENT DOCUMENTS 5,522,847 A * 6/1996 Kalis et al. ..... 606/234
5,662,685 A * 9/1997 Uhler ..... 606/234
6,066,161 A * 5/2000 Parella ..... 606/234

* cited by examiner

*Primary Examiner*—Jeffery Hofsass
*Assistant Examiner*—Jennifer Stone

(57) ABSTRACT

A pacifier locator system for locating a pacifier for a child. The pacifier locator system includes a pacifier having a nipple support member, and also having a nipple being attached to a front side of the nipple support member, and further having a handle being attached to a back side of the nipple support member; and also includes a receiver assembly including a housing being attached to the back side of the nipple support member, and also including a receiver being disposed in the housing, and further including a first microprocessor being connected to the receiver and being powered by a battery; and further includes light-emitting members being attached to the back side of the nipple support member and being connected to the first microprocessor; and a transmitter assembly including a housing member, and also including a transmitter being disposed in the housing member, and further including a second microprocessor being connected to the transmitter and being powered by a battery, and also including control switches being connected to the second microprocessor, and further including an antenna for transmitting radio signals to the receiver.

3 Claims, 2 Drawing Sheets

PACIFIER LOCATOR SYSTEM

BACKGROUND OF THE INVENTION

1. Field of the Invention

The present invention relates to pacifier locators and more particularly pertains to a new pacifier locator system for locating a pacifier for a child.

2. Description of the Prior Art

The use of pacifier locators is known in the prior art. More specifically, pacifier locators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,066,161; U.S. Pat. No. 5,859,585; U.S. Pat. No. 5,662,685; U.S. Pat. No. 6,102,935; U.S. Pat. No. 6,193,742; and U.S. Pat. No. Des. 419,240.

While these devices fulfill their respective, particular objectives and requirements, the aforementioned patents do not disclose a new pacifier locator system. The prior art includes inventions having receivers and sound-producing mechanisms attached to pacifiers for the locations thereof.

SUMMARY OF THE INVENTION

The general purpose of the present invention, which will be described subsequently in greater detail, is to provide a new pacifier locator system which has many of the advantages of the pacifier locators mentioned heretofore and many novel features that result in a new pacifier locator system which is not anticipated, rendered obvious, suggested, or even implied by any of the prior art pacifier locators, either alone or in any combination thereof. The present invention includes a pacifier having a nipple support member, and also having a nipple being attached to a front side of the nipple support member, and further having a handle being attached to a back side of the nipple support member; and also includes a receiver assembly including a housing being attached to the back side of the nipple support member, and also including a receiver being disposed in the housing, and further including a first microprocessor being connected to the receiver and being powered by a battery; and further includes light-emitting members being attached to the back side of the nipple support member and being connected to the first microprocessor; and a transmitter assembly including a housing member, and also including a transmitter being disposed in the housing member, and further including a second microprocessor being connected to the transmitter and being powered by a battery, and also including control switches being connected to the second microprocessor, and further including an antenna for transmitting radio signals to the receiver. None of the prior art includes the combination of the elements of the present invention.

There has thus been outlined, rather broadly, the more important features of the pacifier locator system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new pacifier locator system which has many of the advantages of the pacifier locators mentioned heretofore and many novel features that result in a new pacifier locator system which is not anticipated, rendered obvious, suggested, or even implied by any of the prior art pacifier locators, either alone or in any combination thereof.

Still another object of the present invention is to provide a new pacifier locator system for locating a pacifier for a child.

Still yet another object of the present invention is to provide a new pacifier locator system that is easy and convenient to use.

Even still another object of the present invention is to provide a new pacifier locator system that allows the parent to locate a lost pacifier in the darkness without waking the child.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
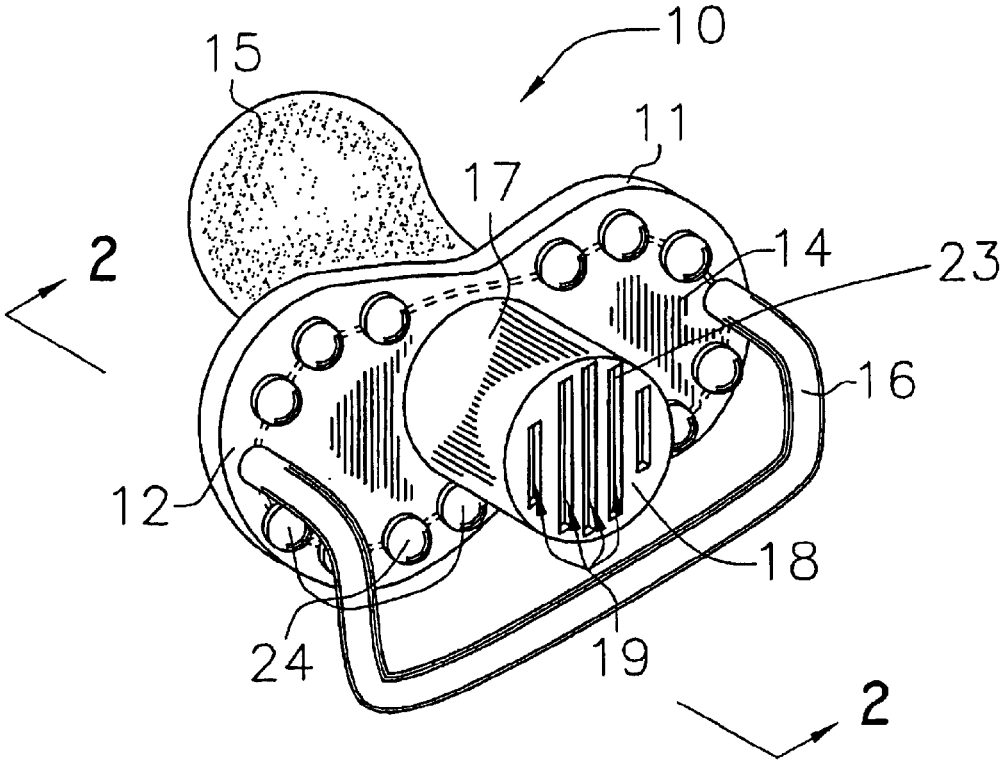
FIG. 1 is a perspective view of a pacifier of new pacifier locator system according to the present invention.
Figure 2:
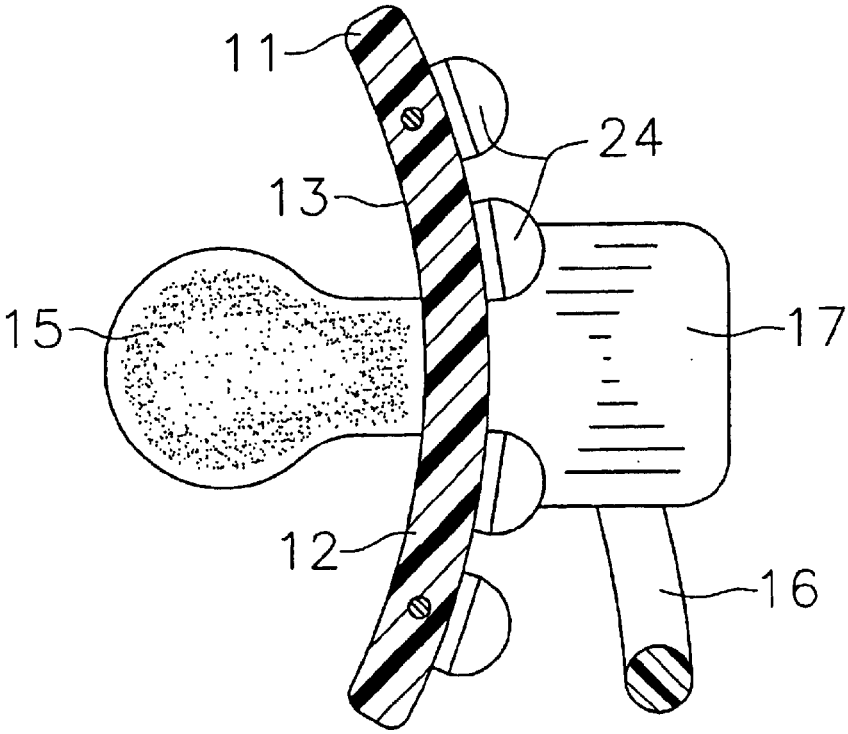
FIG. 2 is a cross-sectional view of the pacifier of the present invention.
Figure 3:
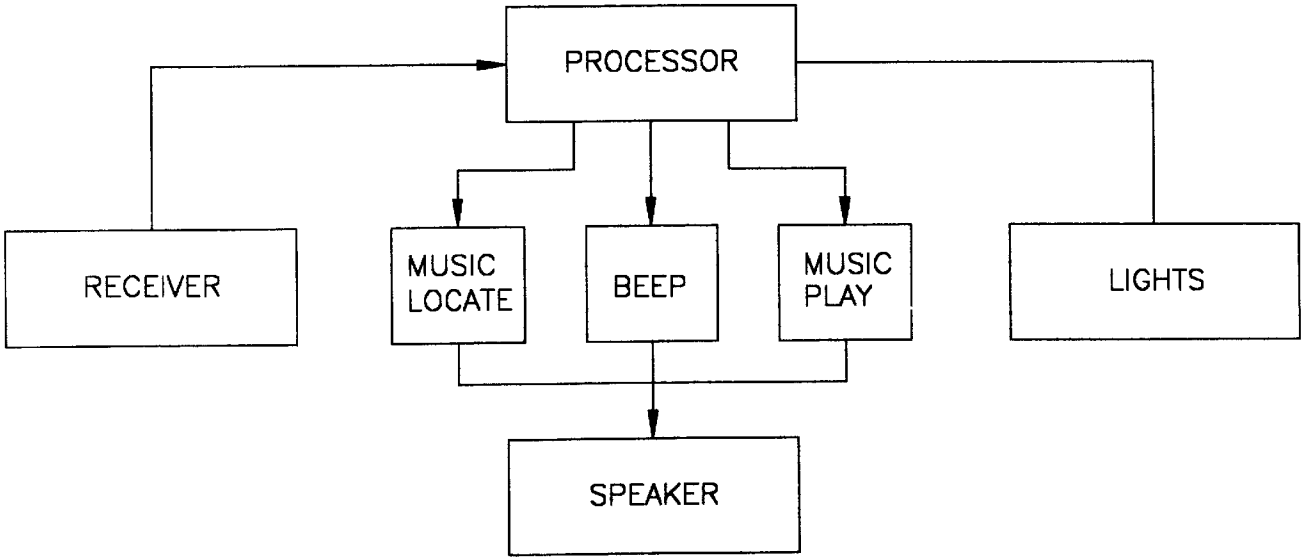
FIG. 3 is a schematic diagram of the present invention.
Figure 5:
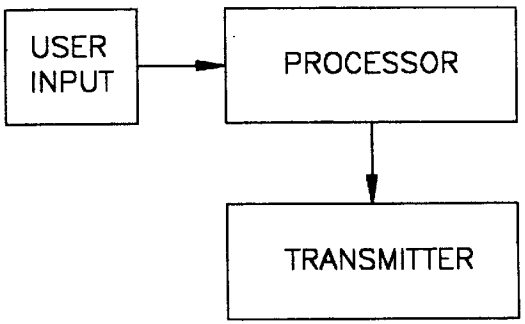
FIG. 5 is a schematic view of the transmitter member of the present invention.
Figure 4:
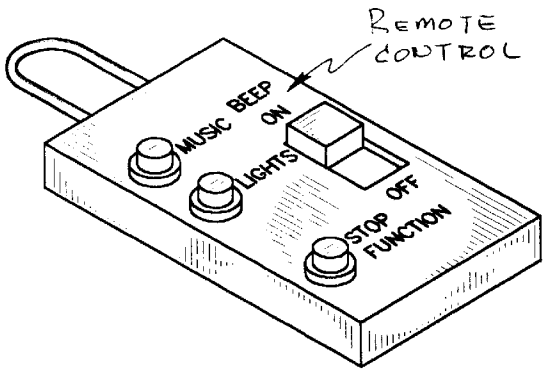
FIG. 4 is a perspective view of a transmitter member of the present invention.

With reference now to the drawings, and in particular to FIGS. 1 through 5 thereof, a new pacifier locator system embodying the principles and concepts of the present invention and generally designated by the reference numeral 10 will be described.

As best illustrated in FIGS. 1 through 5, the pacifier locator system 10 generally comprises a pacifier 11 having a nipple support member 12, and also having a nipple 15 being conventionally attached to a front side 13 of the nipple support member 12, and further having a handle 16 being conventionally attached to a back side 14 of the nipple support member 12.

A receiver assembly includes a housing 17 being conventionally attached to the back side 14 of the nipple support member 12, and also includes a receiver 20 being conventionally disposed in the housing 17, and further including a first microprocessor 21 being conventionally connected to the receiver 20 and being powered by a battery. The housing 17 is cylindrical-shaped and has slots 19 being disposed through an end wall 18 thereof. The receiver assembly also includes a sound-producing mechanism 22 being conventionally connected to the first microprocessor 20, and further includes a speaker 23 being conventionally disposed in the housing 17 and being conventionally connected to the sound-producing mechanism 22 and being disposed over the slots 19. The sound-producing mechanism 23 is capable of emitting beeping noises and also playing musical sounds.

Light-emitting members 24 are conventionally attached to the back side 14 of the nipple support member 12 and are conventionally connected to the first microprocessor 21. The light-emitting members 24 include light-emitting diodes being spacedly attached along a perimeter of the back side 14 of the nipple support member 12.

A transmitter assembly includes a housing member 24, and also includes a transmitter 26 being conventionally disposed in the housing member 24, and further includes a second microprocessor 27 being conventionally connected to the transmitter 26 and being powered by a battery, and also includes control switches 30–33 being conventionally connected to the second microprocessor 27, and further includes an antenna 29 for transmitting radio signals to the receiver 20. The housing member 25 includes a top wall 34 and slot 28 being disposed in the top wall 34. The control switches 30–33 include a power switch 30 which is slidably and conventionally disposed in the slot 28 of the housing member 25, and also include a light switch 32 being depressibly disposed in the top wall 34 of the housing member 25, and further include a music selector switch 31 being depressibly disposed in the top wall 34 of the housing member 25, and also include a beeper switch being depressibly disposed in the top wall 34 of the housing member 25 for actuating a beeping noise from the sound-producing mechanism 22.

In use, the user attaches the housing member 25 to a key chain or something similar and turns on the power to the transmitter assembly by sliding the power switch 30 and actuates either the light-emitting members 24 by depressing the light switch 32 or the music by depressing the music selector switch 31 or the beeping noises by depressing the beeper switch 33 to locate the pacifier 11 for the child.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the pacifier locator system. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A pacifier locator system comprising:

a pacifier having a nipple support member, and also having a nipple being attached to a front side of said nipple support member, and further having a handle being attached to a back side of said nipple support member;

a receiver assembly including a housing being attached to said back side of said nipple support member, and also including a receiver being disposed in said housing, and further including a first microprocessor being connected to said receiver and being powered by a battery, said housing being cylindrical-shaped and has slots being disposed through an end wall thereof, said receiver assembly also including a sound-producing mechanism being connected to said microprocessor, and further including a speaker being disposed in said housing and being connected to said sound-producing mechanism and disposed over said slots, said sound-producing mechanism being capable of emitting beeping noises and also playing musical sounds;

light-emitting members being attached to said back side of said nipple support member and being connected to said first microprocessor, said light-emitting members including light-emitting diodes being spacedly attached along a perimeter of said back side of said nipple support member; and a transmitter assembly including a housing member, and also including a transmitter being disposed in said housing member, and further including a second microprocessor being connected to said transmitter and being powered by a battery, and also including control switches being connected to said second microprocessor, and further including an antenna for transmitting radio signals to said receiver.

2. A pacifier locator system as described in claim 1, wherein said housing member includes a top wall and a slot being disposed in said top wall.

3. A pacifier locator system as described in claim 2, wherein said control switches include a power switch which is slidably disposed in said slot of said housing member, and also include a light switch being depressibly disposed in said top wall of said housing member, and further include a music selector switch being depressibly disposed in said top wall of said housing member, and also include beeper switch being depressibly disposed in said top wall of said housing member for actuating a beeping noise from said sound-producing mechanism.

* * * * *